US006453652B1

(12) United States Patent
Hennig

(10) Patent No.: US 6,453,652 B1
(45) Date of Patent: Sep. 24, 2002

(54) SADDLETREE WITH RESILIENT SUPPORTING ELEMENTS

(76) Inventor: Jochen Hennig, Dorfstr. 64, 14662 Haage (DE)

( * ) Notice: Subject to any disclaimer, the term of this patent is extended or adjusted under 35 U.S.C. 154(b) by 0 days.

(21) Appl. No.: 09/721,685

(22) Filed: Nov. 24, 2000

(51) Int. Cl.[7] ..... B68C 1/02
(52) U.S. Cl. ..... 54/44.1; 54/44.4
(58) Field of Search ..... 54/44.1, 44.4, 54/44.5, 44.7

(56) References Cited

U.S. PATENT DOCUMENTS 497,665 A * 5/1893 Hotze ..... 54/44.1
1,111,817 A * 9/1914 Adams ..... 54/44.4
1,213,329 A * 1/1917 Beal ..... 54/44.1
3,911,648 A * 10/1975 lightfoot ..... 54/44.5
5,517,808 A * 5/1996 Schleese ..... 54/44.1

FOREIGN PATENT DOCUMENTS

DE 3902305 8/1990

* cited by examiner

*Primary Examiner*—Charles T. Jordan
*Assistant Examiner*—Elizabeth Shaw
(74) *Attorney, Agent, or Firm*—Jenner & Block, LLC

(57) ABSTRACT

A saddletree (10) comprising a headiron (16) associated with pommel portion (12) and reaching into skirt ends (15). Saddletree (10) has a cantle portion (13) supported by an arcuate cantle-supporting member (25) and longitudinal spring members (17) extending between the pommel and cantle portions (12, 13). Headiron (16) is provided on both sides with resilient headiron end sections (21).

13 Claims, 3 Drawing Sheets

SADDLETREE WITH RESILIENT SUPPORTING ELEMENTS

DESCRIPTION

The invention relates to a saddletree comprising a headiron associated with the pommel portion and extending down into the skirt end portions, a cantle portion supported by a cantle-supporting member, and longitudinal spring elements extending between the pommel and cantle portions.

A saddletree of this type—as known by DE 37 02 011 C1, for example—serves as supporting frame for a horseback riding saddle. The opening width of the pommel portion in the region of the skirt ends is determined by the opening width of the headiron. Horses have different shoulder widths, however, and the opening width of the saddle rarely corresponds to the horse's actual shoulder width. For this reason, demand is increasing for saddles having an opening width that is optimally matched to the horse so as to obtain a good contact to the animal and to minimize its burden.

It is the object of the present invention to provide a saddletree which allows the horse maximum freedom for shoulder movements and imparts to the horse's rider a seat feeling as uniform as possible regardless of the horse's anatomy.

This object is attained by the headiron being provided with resilient headiron end sections. For example, the headiron may be provided on both sides with recesses disposed a predetermined distance from the skirt ends, with the resilient headiron end sections attached to the headiron in said recesses by means of fasteners.

These measures result in a saddletree which adapts in both a longitudinal and transverse direction to varying horse anatomies and allows the horse maximum freedom for shoulder movements.

Rearward movement of the rider would cause the cantle to generate a tilting torque, which the horse would sense as a strong specific pressure acting on its back via the cantle panel; as a result, the horse would experience substantial discomfort and be less inclined to perform. For this reason, a resilient arcuate supporting member is inserted between the cantle and the cantle panel and is secured to the latter. This member allows the cantle to yield downwards so that no tilting torque can be transmitted to the horse's back.

Because of the different widths of horses' backs, saddles should have different widths. This often conflicts with the rider's desire to experience an optimum seat feeling, which in turn depends on the rider's build.

For this reason, a preferred embodiment of the inventive saddletree has a reduced-width section transversely restricted to meet the seat section, with the longitudinal spring members extending between the pommel and cantle portions outside the restricted section. This allows the saddle to be formed to have various widths. The spring elements extending outside the restricted section are very thin and enable a saddle build to be obtained which does not impair the seat feeling.

Further advantageous measures are described in the dependent claims. The invention is shown in the attached drawing and will be described in greater detail below. In the drawing:

Figure 1:
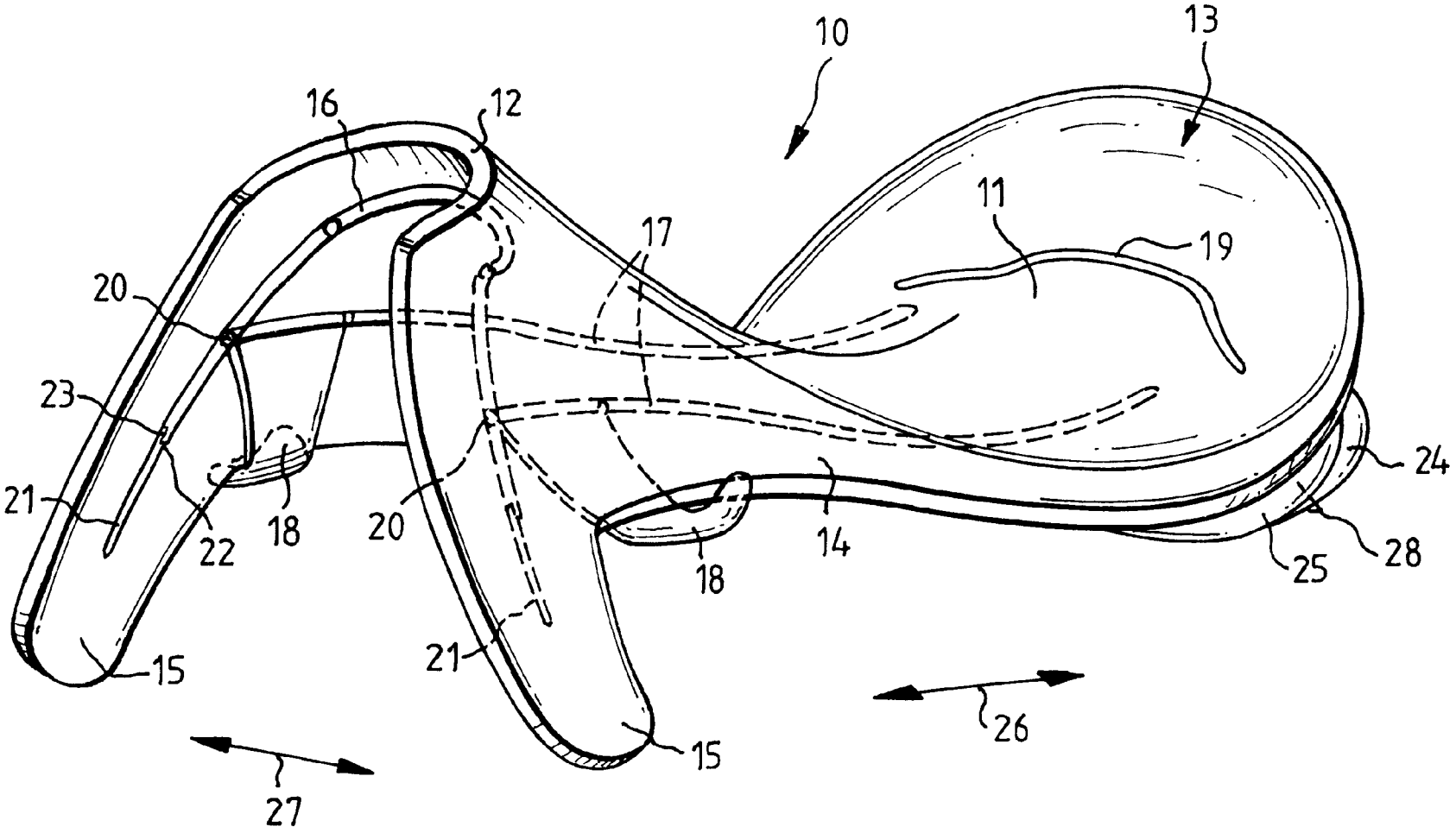
FIG. 1 shows an isometric view of a saddletree with resilient supporting inserts.

The saddletree 10 shown in FIGS. 1 to 4 consists essentially of a seat section 11 extending between a pommel portion 12 and a cantle portion 13.

Pommel portion 12 has inserted therein a headiron 16 to extend down into the skirt ends 15. Headiron 16 has headiron end sections 21 fabricated separately from headiron 16. In accordance with the invention, headiron ends 21 are made to be resilient and are secured to headiron 16 by fastening means 23.

In the area of skirt ends 15, headiron 16 is provided with recesses 22 which receive headiron end sections 21 to be secured therein by fastening means 23. Extending between pommel and cantle portions 12 and 13, respectively, there are longitudinal spring members 17. Longitudinal spring members 17 and headiron 16 have stirrup strap suspension springs 18 associated therewith.

Figure 3:
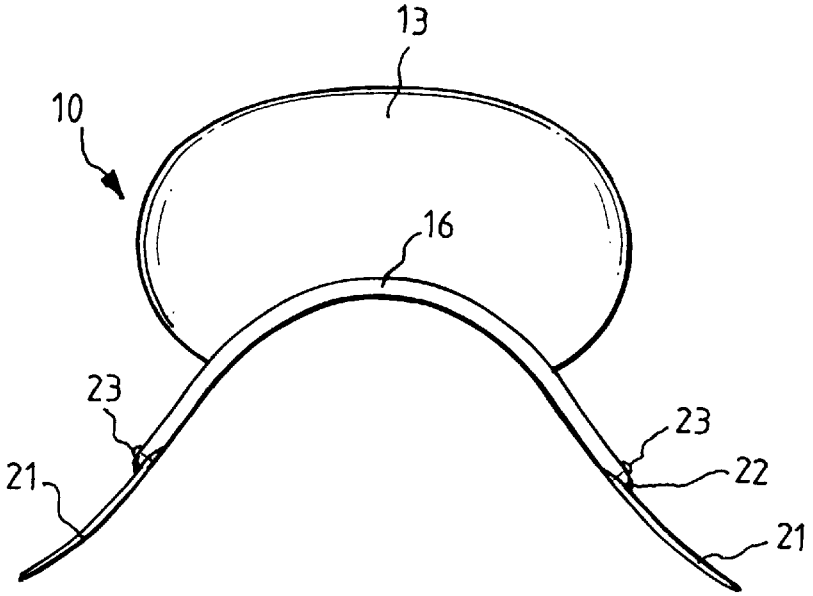
FIG. 3 shows a front view of a saddletree according to FIG. 1 having a headiron with resilient headiron end sections.

Headiron 16 usually consists of a relatively rigid forged or cast member, whereas—see FIG. 3—headiron end sections 21 are made of a relatively thin and resiliently deformable material. As a result, headiron end sections 21 can deflect resiliently in a transverse direction 27. A spring-grade steel, a light-weight metal, a plastics material or the like are suited for use as resiliently deforming material for headiron end sections 21.

In another embodiment, headiron end sections 21 are formed of resiliently deformable circular-section stock to enable them to move out of the way in a longitudinal direction 26 also. It is equally possible to make headiron 16 of a light-weight resiliently deformable material, such as titanium, in its entirety.

Figure 2:
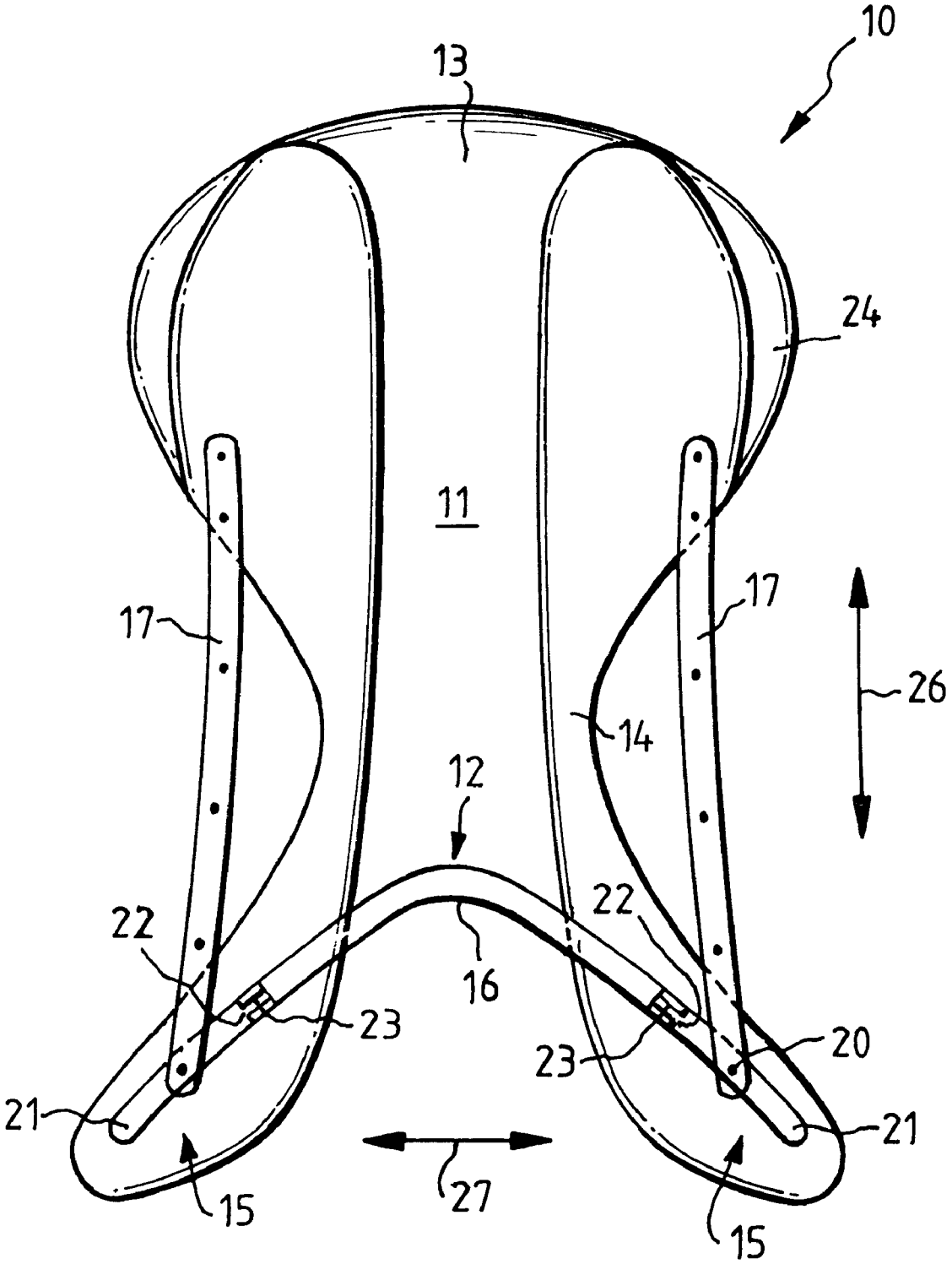
FIG. 2 shows a saddletree according to FIG. 1 in plan with outwardly shifted longitudinal spring members and a headiron with resilient headiron end sections.

As shown in FIG. 2, seat section 11 has a region 14 greatly reduced in width. On both sides of reduced-width region 14, longitudinal spring elements 17 are outwardly displaced in transverse direction 27.

Longitudinal spring elements 17 extend between a cantleiron 19 and headiron 16. They are connected with headiron 16 at points of attachment 20. Headiron 16 can be provided with a plurality of points of attachment 20, which would enable the attachment of longitudinal spring elements 17, which determines the width of seat section 11, to be varied. Likewise, longitudinal spring elements 17 can be formed to be S-shaped in plan, with their converging sections in the area of reduced-width section 14.

Longitudinal spring elements 17 consists of a resiliently deformable material and are made to be thin enough not to protrude noticeably from seat section 11. As a result, the outwardly displaced longitudinal spring elements 17 will not impair the rider's seat feeling even if the saddle is made to be broader in transverse direction 27.

Figure 4:
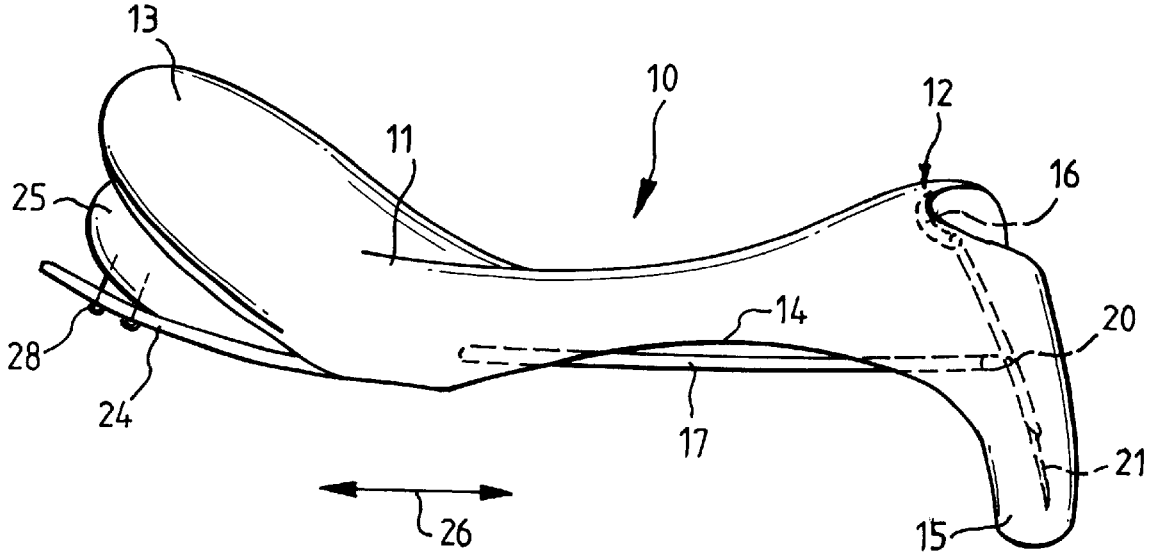
FIG. 4 shows a side view of a saddletree according to FIG. 1, with a resiliently yielding arcuate cantle insert member releasably attached to the cantle panel.

As shown in FIG. 4, cantle portion 13 is connected with a cantle panel 24 via an arcuate cantle-supporting member 26. Member 25 is made to be resilient and is fabricated as a separate component. It can be connected releasably to cantle panel 24 by connecting means 28. In this way, cantle portion 13 is free to yield downwardly when loaded, with that loading not causing pressure to be exerted on cantle panel 24. In fact, cantle panel 24 may itself be made to be resilient so as to cushion the rider against riding shocks coming from the horse.

List of Reference Characters

10 saddletree
11 seat section
12 pommel portion
13 cantle portion
14 reduced-width section
15 skirt end
16 headiron
17 longitudinal spring member
18 stirrup strap receiving spring member
19 cantleiron
20 point of attachment
21 headiron end section
22 recess
23 fastening means
24 cantle panel
25 arcuate cantle-supporting member
26 longitudinal direction
27 transverse direction
28 fastening means

What is claimed is:

1. A saddletree, comprising:

a headiron associated with the pommel portion and extending into the skirt ends;

a cantle portion supported by an arcuate cantle supporting member; and longitudinal spring members extending between the pommel portion and the cantle portion;

wherein said headiron is provided with resilient headiron end sections.

2. A saddle tree as in claim 1, wherein said headiron end sections are releasably connected to said headiron; and wherein said headiron end sections are resiliently deformable in a transverse direction.

3. A saddletree as in claim 1, wherein said headiron has a recess formed therein on at least one side and wherein a said headiron end section is connected to said headiron in said recess by a fastening means.

4. A saddletree as in claim 1, wherein said headiron comprises spring-grade steel, elastic light-weight metal, titanium or a plastics material.

5. A saddletree as in claim 1, further comprising a reduced-width portion restricted in the transverse direction, and wherein said longitudinal spring elements extend between said pommel and said cantle outside of said reduced-width section.

6. A saddletree as in claim 5, wherein said longitudinal spring elements are formed to be S-shaped in plan to converge in the area of said reduced-width section.

7. A saddletree as in claim 1, wherein said longitudinal spring members are formed to be resilient and are connected to said headiron at variable points of attachment.

8. A saddletree as in claim 1, wherein said arcuate cantle supporting member is variably secured to a cantle panel.

9. A saddletree as in claim 8, wherein said arcuate cantle supporting member is formed to be resilient and is connected to said cantle panel by a fastening means.

10. A saddletree as in claim 8, wherein said cantle panel is formed to be resilient.

11. A saddletree as in claim 1, wherein said headiron end sections are releasably connected to said headiron; and wherein said headiron end sections are resiliently deformable in a longitudinal direction.

12. A saddletree as in claim 1, wherein at least one said headiron end section comprises spring-grade steel, elastic light-weight metal, titanium or a plastics material.

13. A saddletree as in claim 1, wherein said longitudinal spring members are formed to be resilient and are connected to said headiron end sections at variable points of attachment.

* * * * *

UNITED STATES PATENT AND TRADEMARK OFFICE

CERTIFICATE OF CORRECTION

PATENT NO. : 6,453,652 B1
DATED : September 24, 2002
INVENTOR(S) : Jochen Hennig It is certified that error appears in the above-identified patent and that said Letters Patent is hereby corrected as shown below:

Column 2,
Line 60, delete “26” and insert -- 25 --

Signed and Sealed this

First Day of April, 2003

JAMES E. ROGAN
*Director of the United States Patent and Trademark Office*